United States Patent [19]

Hardin

[11] 4,019,079

[45] Apr. 19, 1977

[54] GAS INJECTED VACUUM SWITCH

[75] Inventor: K. Dan Hardin, Albuquerque, N. Mex.

[73] Assignee: The United States of America as represented by the United States Energy Research and Development Administration, Washington, D.C.

[22] Filed: May 7, 1976

[21] Appl. No.: 684,420

[52] U.S. Cl. ..... 313/231.4; 313/174; 313/233

[51] Int. Cl.[2] ..... H01J 17/26; H01J 19/68; H01J 21/00

[58] Field of Search ..... 313/177, 174, 231.3, 313/231.4, 233; 200/144 B

[56] References Cited

UNITED STATES PATENTS

| | | | |
|---|---|---|---|
| 2,873,400 | 2/1959 | Cook | 313/231.3 |
| 2,975,332 | 3/1961 | Starr | 313/231.3 X |
| 3,188,514 | 6/1965 | Cobine | 313/174 |
| 3,509,406 | 4/1970 | Rich | 313/233 X |
| 3,581,142 | 5/1971 | Boxman | 200/144 B X |

*Primary Examiner*—Palmer C. Demeo
*Attorney, Agent, or Firm*—Dean E. Carlson; Dudley W. King; Robert W. Weig

[57] ABSTRACT

The disclosure relates to a gas injected vacuum switch comprising a housing having an interior chamber, a conduit for evacuating the interior chamber, within the chamber an anode and a cathode spaced from the anode, and a detonator for injecting electrically conductive gas into the chamber between the anode and the cathode to provide a current path therebetween.

6 Claims, 3 Drawing Figures

GAS INJECTED VACUUM SWITCH

FIELD OF THE INVENTION

The invention relates to vacuum switches and more particularly to a gas injected vacuum switch wherein a gaseous medium injected between spaced anode and cathode provides a current path therebetween.

BACKGROUND OF THE INVENTION

There is at present a need for a switch substantially insensitive to radiation, a somewhat active chemical environment, stray noise and transient currents, capable of producing a clean, high current, transient-free, damped oscillatory RLC discharge. State of the art solid polymer dielectric switches are typically sensitive to environments containing moisture, chemically active substances, and ionizing radiation. Such switches produce a rough current waveform because of bounce and jitter in contact closure. Too, solid dielectric switches can not be 100% tested to ultimate breakdowns because their breakdown mechanism is destructive, making them one shot only devices. Presently available spark gap switches are very sensitive to ionizing radiation.

Electrically triggered vacuum switches in use today are sensitive to stray noise which will prematurely trigger the tube. These switches also exhibit a rough current output waveform because there is very little gas present in their tubes with which to initiate arc discharge.

There hence exists a need for a switch having immunity to noise triggering, a "clean" output waveform, and 100% hold-off testability.

SUMMARY OF THE INVENTION

In accordance with the present invention there is provided a gas injected vacuum switch comprising a housing having an interior chamber, a conduit for evacuating the interior chamber, an anode disposed within the chamber, a cathode disposed within the chamber and spaced from the anode, and structure such as a detonator for injecting electrically conductive gaseous material into the chamber to provide a path for electric current between the anode and the cathode. In a preferred embodiment, the gaseous material comprises detonation products of the detonator, and passes through apertures in the anode and/or the cathode into the space therebetween.

One object of the present invention is to provide a clean, damped oscillatory RLC discharge.

Another object of the present invention is to provide switching reliability and dependability in a hostile environment which may comprise for example, ionizing radiation, chemically active substances, severe shock and vibration, and electromagnetic fields.

Yet another object of the invention is to provide switching using lower explosive force than prior art devices require.

One advantage of the present invention is that in accordance therewith switching is not degraded by moisture adsorption.

Another advantage of the present invention is that a switch in accordance therewith is very insensitive to stray noise and transients, the switch's interior containing no trigger mechanism.

Another advantage of the present invention is that a switch in accordance therewith can be 100% tested to ultimate breakdowns.

Other objects and advantages of the present invention will be apparent to those skilled in the art from the following description with reference to the appended drawings wherein like numbers denote like parts and wherein:

DETAILED DESCRIPTION OF A PREFERRED EMBODIMENT OF THE INVENTION

Figure 1:
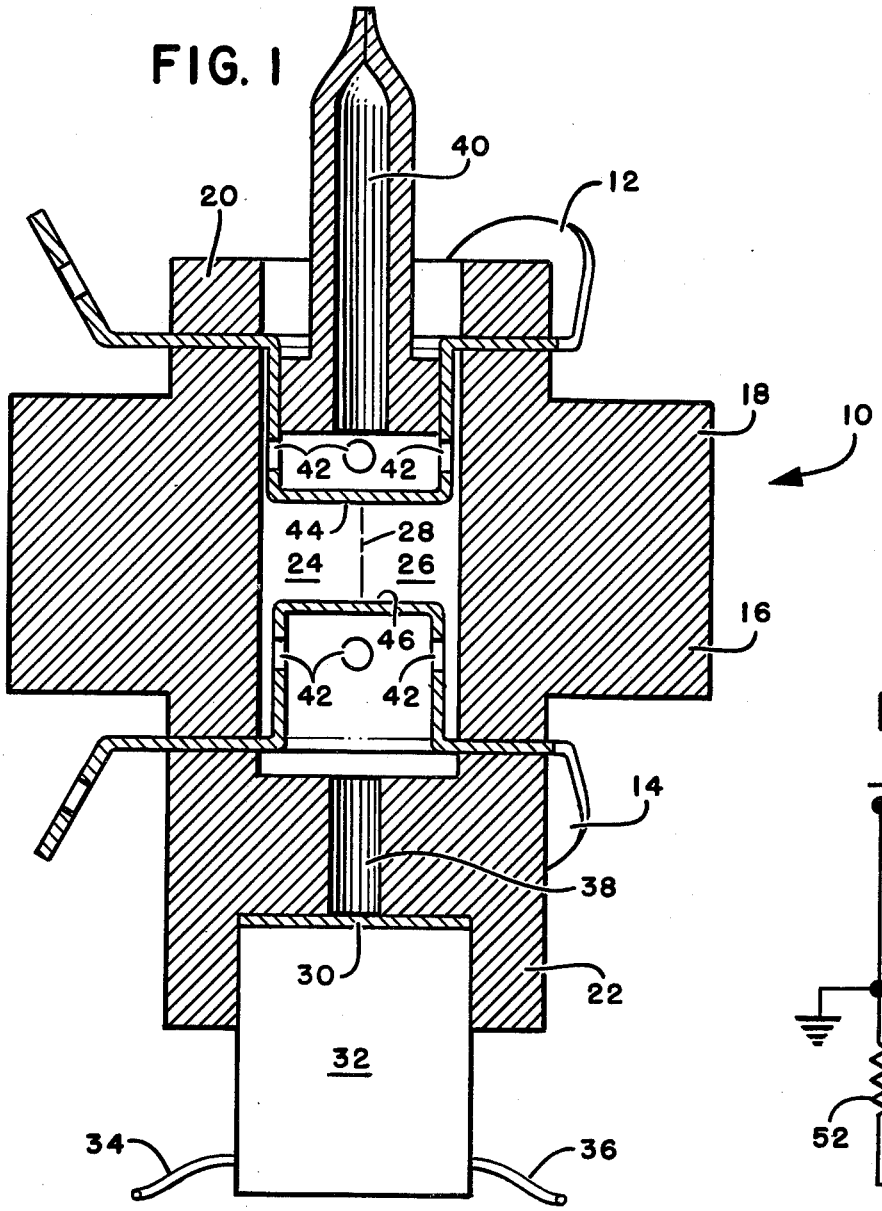
FIG. 1 is a cross-sectional illustration of a switch in accordance with the invention.

An exemplary switch in accordance with the invention is seen in FIG. 1 which shows a gas injected vacuum switch 10 containing an anode 12 and a cathode 14. A housing 16 comprises a central portion 18, an anode end portion 20, and a cathode end portion 22. In the preferred embodiment the housing 16 may comprise for example a ceramic such as high alumina (greater than 94% alumina), forsterite, zircon, or sapphire. The anode 12 and the cathode 14 may comprise any of the metals typically used in the electrical and electronic arts for electrical conductive purposes and in making vacuum to ceramic seals, such as copper, gold, titanium, molybdenum, silver-copper alloys, silver-gold alloys, and nickel-iron-cobalt alloys. Housing 16 defines an interior chamber 24 having a wall 26. In the preferred embodiment illustrated, the interior chamber 24 is generally clyindrical along a longitudinal axis of rotation 28. The chamber 24 may be sealed from an external environment at cathode end portion 22 by a seal 30 against one side of which is disposed a detonator 32 which may be detonatable in any manner known to those skilled in the art. However, in the preferred embodiment the detonator 32 is an electrically fired detonator having leads 34 and 36. Upon detonation, gas from detonator 32 penetrates or breaches seal 30 and enters interior chamber 24 through a conduit 38 in end portion 22 providing a passageway for the detonation products of the detonator to interior chamber 24.

Seal 30 is applied by brazing it to the metallized ceramics of end portion 22 in a controlled atmosphere furnace, a well-known technique. The structural material of housing 16 is preferably suitable hermetically sealed to the appropriate surface portions of anode 12 and cathode 14 also by this well-known brazing technique. The gaseous contents of interior chamber 24, conduit 38, and an evacuation conduit 40 are evacuated through conduit 40 which is connected to a vacuum pump. After the vacuum within the chamber 24 reaches a pressure less than about $10^{-4}$ Torr, the conduit 40 which may comprise, for example, copper, is "pinch" sealed in the manner well-known to those of ordinary skill in the art. It will be appreciated by those skilled in the art that the above mentioned compositions for seal 30, anode 12, cathode 14, conduit 40 and housing 16 are exemplary only and that other well-known materials may be used. The detonator 32 which also may comprise any device known by those skilled in the art capable of operably activating the switch may be epoxied or otherwise affixed to the material of cathode end portion 22 of the housing 16.

Exemplary of the types of detonators which may be used in practicing the invention are a hot wire detonator and exploding bridgewire. Too, seal 30 may be directly heated by passing a high current electrical discharge through the metal, rupturing the seal and allowing surrounding gas to be injected into the tube to trigger the switch.

In the preferred embodiment shown, anode 12 and cathode 14 each contain apertures 42 in the walls of their capped cylindrical structures. These apertures allow gaseous material entering through cathode 14 to enter the space between the anode 12 and the cathode and also act as pumping ports to evacuate the switch during its manufacture. Thus, the apertures in the anode 12 provide for pressure equalization throughout interior chamber 24 sufficient for the structures of metallic anode 12 and cathode 14 to withstand the action of the injected gaseous material in order for the switch to operate.

It will be readily appreciated that the cathode 14 and the anode 12 are interchangeable and that element 12 may be utilized as a cathode and element 14 as an anode in any desired circuit.

Those of ordinary skill in the art will also realize that some deformation of the anode and/or the cathode is tolerable; but the deformation should be insufficient to effect the operability of the switch. The spacing between anode top portion 44 and cathode top portion 46 may be varied to minimize switch inductance by minimizing spacing.

Figure 2:
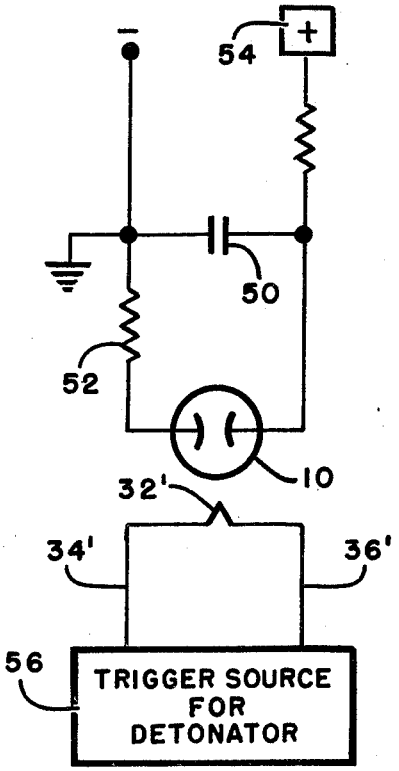
FIG. 2 shows a simple circuit in which the switch of FIG. 1 may be used.

FIG. 2 shows a simple circuit in which a gas injected vacuum switch in accordance with the invention may be used. In the circuit 48 illustrated in FIG. 2, the switch 10 electrically separates an energy storage device such as a capacitor or capacitor bank 50 from a load 52. Capacitor 50 may be charged from, for example, a charging source 54. The switch 10 may be detonated by a trigger circuit 56, the switch's detonator 32' being connected thereto by leads 34' and 36'. The FIG. 2 schematic illustration of the detonator is for the sake of simplicity and it will be realized that the detonator 32' is actually within the switch 10 as shown in FIG. 1. When the gas injected vacuum switch 10 is to be armed, voltage is applied by charging source 54 at an energy rate sufficient to charge capacitor 50 in the time required. Trigger circuit 56 produces a pulse to initiate the detonator and thereby the gas injection mechanism of the switch. An arc discharge occurs between the anode and the cathode electrodes within the switch to transfer the energy stored in energy storage capacitor 50 to the load 52.

The gas injected vacuum switch of the invention can utilize a much lower explosive force to rupture seal 30 than that needed to reliably close solid metal foils through a solid dielectric switch. An electrically triggered vacuum switch provides a rough output current waveform not characteristic of the switch of the invention. Furthermore, a solid dielectric switch can not be 100% tested to ultimate breakdowns as can the gas injected vacuum switch of the invention.

The vacuum level in the switch of the invention can be controlled or preselected to be at any level desired to meet the radiation tolerance and hold-off capability required in a particular application. Typically, the residual gas pressure is less than about $10^{-4}$ Torr. Controlled residual gas pressures may be obtained within the switch to maintain electrode surface conditions or to obtain special characteristics.

Figure 3:
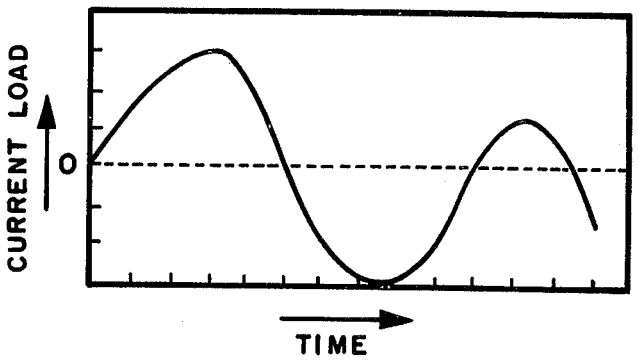
FIG. 3 graphically depicts a typical output to be expected from the switch of FIG. 1.

FIG. 3 graphically depicts a typical current-time discharge plot of a switch in accordance with the invention. It will be noted that the waveform is smooth compared to that of a typical prior art solid state switch or an electrically triggered vacuum switch. This indicates that there is no transient switching noise which is particularly undesirable on the leading edge of a waveform. The transients present in prior art switches provide a rough profile which makes instrumentation difficult because instruments frequently respond adversely to curve changes caused by transients. Therefore, the smooth waveform of the switch of the invention is highly desirable.

What the detonation products or gases introduced between the anode and the cathode are is unimportant as long as they conduct when ionized by applied voltage. Thus, many types of detonators may be used.

The various features and advantages of the invention are thought to be clear from the foregoing description. However, various other features and advantages not specifically enumerated will undoubtedly occur to those versed in the art, as likewise will many variations and modifications of the embodiment illustrated herein, all of which may be achieved without departing from the spirit and scope of the invention as defined by the appended claims.

I Claim:

1. A gas injected vacuum switch comprising;

a housing having a generally cylindrical interior chamber; first conduit means operably connected to said chamber for evacuating said chamber;

an anode disposed within said chamber;

a cathode, spaced from said anode, disposed within said chamber;

second conduit means for providing a passageway into said chamber;

means for sealing said chamber from said second conduit means; and means for producing electrically conductive gaseous material, for breaching said seal, and for injecting said material through said second conduit means into said chamber to provide a conductive path for electric current between said anode and said cathode.

2. The invention of claim 1 wherein said cylindrical chamber has a longitudinal axis therethrough, said first conduit means is cylindrical, having a longitudinal axis, and the longitudinal axes of said chamber and said first conduit means are aligned.

3. The invention of claim 1 wherein said cylindrical chamber has a longitudinal axis therethrough, said second conduit means is cylindrical, having a longitudinal axis, and the longitudinal axes of said chamber and said second conduit means are aligned.

4. The invention of claim 1 wherein at least one of said anode and cathode contains aperture means for providing passage of said gaseous material therethrough.

5. The invention of claim 4 wherein said chamber comprises a cylindrical wall and said anode and said cathode are each generally cylindrical, each having a wall and having a longitudinal axis axially aligned with said axis of said chamber, said anode and said cathode being smaller in diameter than said chamber so that said walls of said anode and cathode are spaced inwardly from said wall of said chamber.

6. The invention of claim 5 wherein said walls of said anode and said cathode contain said aperture means.

* * * * *